US005695281A

United States Patent [19]

Weber et al.

[11] Patent Number: 5,695,281

[45] Date of Patent: Dec. 9, 1997

[54] DEVICE FOR MANUFACTURING PAINT

[75] Inventors: Hans Weber, Waldshut-Tiengen; Anton Müller, Albbruck-Birndorf, both of Germany

[73] Assignee: Inotec GmbH Transport- und Förtersysteme, Waldshut-Tiengen, Germany

[21] Appl. No.: 572,860

[22] Filed: Dec. 14, 1995

[30] Foreign Application Priority Data

Dec. 14, 1994 [DE] Germany ..... 9419965 U

[51] Int. Cl.[6] ..... B01F 9/02; B01F 3/14; B02C 17/16

[52] U.S. Cl. ..... 366/235; 366/605; 241/98

[58] Field of Search ..... 366/14, 219, 234, 366/235, 605; 241/98, 43, 21, 171, 172

[56] References Cited

U.S. PATENT DOCUMENTS

| | | | |
|---|---|---|---|
| 2,297,804 | 10/1942 | Siegfried | 366/235 |
| 2,351,870 | 6/1944 | Newhouse . | |
| 2,416,746 | 3/1947 | Gavin | 366/234 |
| 2,754,067 | 7/1956 | Klugh . | |
| 4,813,784 | 3/1989 | Musil . | |
| 5,484,200 | 1/1996 | Bradshaw | 366/15 |

FOREIGN PATENT DOCUMENTS

| | | |
|---|---|---|
| 0157454 | 10/1985 | European Pat. Off. . |
| 969933 | 12/1950 | France . |
| 1085845 | 2/1955 | France . |
| 2603819 | 3/1989 | France . |
| 152323 | 3/1903 | Germany . |
| 3009332 | 10/1980 | Germany . |
| 3612853 | 2/1987 | Germany . |
| 4116421 | 10/1992 | Germany . |
| 12271 | 6/1994 | WIPO . |

*Primary Examiner*—Tony G. Soohoo
*Attorney, Agent, or Firm*—Robert W. Becker & Associates

[57] ABSTRACT

A device for manufacturing paint by mixing a dry paint powder with water has a paste mixing zone for mixing dry paint powder with water to a paint paste. The paste mixing zone has an inlet for the dry paint powder. The paste mixing zone further has a mixing and conveying member and a water inlet for supplying water to the dry paint powder. A grinding zone is positioned downstream of the paste mixing zone for grinding the dry paint powder contained in the paint paste and producing finished paint from the paint paste. An exit zone is positioned downstream of the grinding zone for removing the finished paint.

17 Claims, 2 Drawing Sheets

DEVICE FOR MANUFACTURING PAINT

BACKGROUND OF THE INVENTION

The present invention relates to a device for manufacturing paint by mixing dry paint powder with water.

It is known to manufacture liquid paint such that dry paint powder is mixed with water. This is done such that dry paint powder and water are placed into a container and subsequently mixed together until the liquid paint has the required consistency whereby the mixing is mechanically carried out with a stirring device. However, it is disadvantageous that the paint can be manufactured only in small quantities. In particular, the known manufacturing process has the disadvantage that a continuous manufacture of liquid paint is impossible because the paint can only be mixed in a batch wise operation.

It is therefore an object of the present invention to provide a device for manufacturing paint with which especially a continuous manufacture of paint is possible.

SUMMARY OF THE INVENTION

A device for manufacturing paint by mixing dry paint powder with water according to the present invention is primarily characterized by:

A paste mixing zone for mixing dry paint powder with water to a paint paste, the paste mixing zone having an inlet for the dry paint powder;

The paste mixing zone having a mixing and conveying member and a water inlet for supplying water to the dry paint powder;

A grinding zone, positioned adjacent to the paste mixing zone, for grinding the dry paint powder contained in the paint paste and producing finished paint from the paint paste;

An exit zone positioned adjacent to the grinding zone for removing the finished paint.

Advantageously, the device comprises a mixing and conveying pipe in which the paste mixing zone, the grinding zone, and the exit zone are positioned in sequence, wherein the mixing and conveying member comprises a shaft positioned in the mixing and conveying pipe and wherein the water inlet is connected to the mixing and conveying pipe.

Advantageously, the device comprises a means for controlling the amount of water as a function of the amount of dry paint powder fed into the paste mixing zone.

Expediently, the grinding zone comprises a plurality of grinding members arranged in a dense packing in which the grinding members rest at one another and are movable relative to one another, the paint paste being passed through the packing of the grinding members.

Preferably, the grinding members are balls. Advantageously, the grinding zone comprises a cylindrical drum for receiving the grinding members. The cylindrical drum has a first end face and a second end face. The first and second end faces are preferably perforated plates and/or sieve plates.

In a preferred embodiment of the present invention the shaft extends from the paste mixing zone to the exit zone through the mixing and conveying pipe and the cylindrical drum is fixedly connected to the shaft.

Advantageously, the cylindrical drum comprises partitions for dividing the cylindrical drum into segments. The partitions are preferably perforated plates and/or sieve plates.

In yet another embodiment of the present invention the grinding zone has an additional water inlet.

Preferably, the exit zone comprises a rotatable outlet socket with which a required filling level within the device is adjustable.

Advantageously, the device further comprises an auxiliary conveying zone, positioned between the paste mixing zone and the grinding zone, for conveying the paint paste. Advantageously, the auxiliary conveying zone is comprised of stationary slanted blades.

Expediently, the device further comprises an auxiliary mixing and conveying zone positioned between the grinding zone and the exit zone.

According to the present invention, the device comprises a paste mixing zone with a mixing and conveying device for the dry paint powder supplied thereto and with a water inlet arranged thereat and furthermore comprises a grinding zone positioned downstream of the paste mixing zone for grinding the paint powder to which water has been added and also comprises an exit zone for the finished paint which is positioned downstream of the grinding zone.

With this design an automatically operating paint mixing device is provided with which primarily a continuous manufacture of paint is possible so that the dry paint powder supplied to the device, after mixing with water, can be applied continuously and without interruptions, for example, to the facade of a building. According to the present invention, the dry paint powder to be used for manufacturing the paint is first supplied to the manufacturing device with a respective feeding device. In a first manufacturing step the dry paint powder is mixed with water in the paste mixing zone so that a paint paste results which simultaneous to the mixing process, is conveyed to the grinding zone arranged downstream of the paste mixing zone in the direction of conveying where the paint paste is then ground up and homogenized in order to produce in this manner the finished liquid paint of conventional consistency. The finished paint can then be removed via the exit zone, for example, by pumping the liquid paint or by immediately using, i.e., applying the liquid paint. Thus, the present invention provides for a multi-step device in which first a paint paste is produced which is then homogenized in a subsequent grinding process.

Preferably, the paste mixing zone comprises a mixing and conveying pipe with a shaft arranged therein and with a water inlet arranged thereat. The shaft is rotatably supported within the mixing and conveying pipe and, for the mixing process, is provided with respective mixing paddles or similar devices but also with conveying paddles for conveying the paste, which are, for example, in the form of slantedly positioned blades. Instead of these conveying paddles, it is, of course, also possible to use other transporting devices, for example, a worm gear conveyor.

In a further embodiment of the inventive manufacturing device it is suggested that the amount of water supplied to the device is controlled as a function of the amount of dry paint powder supplied to the device. This means that the amount of water to be added to the dry paint powder is always exactly measured (metered) so that the finished paint has automatically the desired water contents.

In a preferred constructive embodiment of the grinding zone a plurality of grinding members is provided which are arranged in a dense packing so as to rest at one another and so as to be movable relative to one another. Through the packing of grinding members the paint in its paste form is guided. The basic idea of such a grinding device is to provide a plurality of loose grinding members which, especially by moving a corresponding receiving container, are moved relative to one another. The grinding members which roll or slide on one another thus define between abutting grinding members respective small grinding and mixing units with the result that the paint paste is mixed and ground between the grinding members so that finally a homogenous uniform consistency of the liquid paint is achieved. The grinding and mixing degree, of course, depends on the length of the grinding zone as well as the through put of the paint.

Preferably, the grinding members are balls and consist, for example, of glass, metal, ceramic or any other suitable solid (hard) material. The balls have the advantage that they can roll on one another and thus provide for optimal grinding efficiency.

In another embodiment it is suggested that the grinding members are arranged within a rotating cylindrical drum whereby the two end faces are formed by perforated plates or sieve plates. The basic principle is thus to fill such a drum especially with balls and to rotate this drum so that the balls are constantly moved and relocated to thereby provide for a grinding operation. The drum accordingly comprises a closed cylinder mantle while the two end faces are provided with openings whereby one end face is the inlet for the paint paste and the other end face is the exit for the finished liquid paint. The perforated plates or sieve plates for the end faces have corresponding openings with a diameter that is, of course, smaller than the diameter of the balls.

In a preferred constructive embodiment, it is suggested that the drum is arranged within the mixing and conveying pipe and is fixedly connected to the shaft. This means that when in the paste mixing zone the shaft is rotated and the paint paste is formed, the drum is simultaneously and synchronously rotated within the grinding zone. This is advantageous because the shaft and the drum thus form a constructive unit together with the mixing and conveying pipe which is not only present within the paste mixing zone but also within the grinding zone. However, it has a considerably greater diameter in the grinding zone than in the paste mixing zone in order to be able to receive the drum.

In another embodiment it is suggested that the drum is divided into segments whereby the partitions are preferably comprised of perforated plates or sieve plates. The drum thus comprises partitions radially arranged relative to the central axis of the drum. These partitions divide the drum into individual chambers in which the respective ball packings are provided. The partitions may be provided with openings which allow for penetration of the paint but prevent passage of the balls. The advantage of drum segments is that the balls in each individual segment are subject to a certain spatial limitation. In particular, the drum segments have the advantage that the paint will not collect, due to gravity, at the lower drum portion. Instead, the drum is uniformly filled with paint because of the segmentation.

In an optimal embodiment of the present invention the grinding zone may be provided with an additional water inlet in order to thin the paint paste produced within the paste mixing zone with more water. This additional water inlet can also be used to clean the inlet side of the drum continuously. However, additional water introduction is not a requirement and can be omitted.

In a further embodiment of the present invention, an outlet socket is rotatably positioned at the exit zone with which it is possible to adjust the required filling level within the mixing device.

With yet another embodiment it is suggested that between the paste mixing zone and the grinding zone an additional conveying device for the paste paint is provided. This has the advantage that the paint paste produced within the paste mixing zone is transported into the grinding zone without backing up so that a continuous transport of the paint paste is possible.

Preferably, the additional conveying device is comprised of stationary slanted shearing blades. Accordingly, between the paste mixing zone and the grinding zone a shearing zone with at least four shearing blades is provided. The paint paste which is subjected to a rotational movement is subjected to an additional axial component due to the presence of the shearing blades which are slanted relative to the longitudinal axis of the shaft. This results in a forward conveying of the paint paste. In order to provide for a uniform transportation, the shearing blades are preferably uniformly distributed over the entire circumference of the pipe. In the area of these shearing blades the aforementioned additional water inlet may be positioned.

It is also suggested in a further embodiment of the present invention that between the grinding zone and the exit zone an additional mixing and conveying zone is provided. This additional mixing and conveying zone may be formed by the shaft extending therethrough and provided with mixing and conveying paddles.

BRIEF DESCRIPTION OF THE DRAWINGS

The object and advantages of the present invention will appear more clearly from the following specification in conjunction with the accompanying drawings, in which.

DESCRIPTION OF THE PREFERRED EMBODIMENTS

Figure 1:
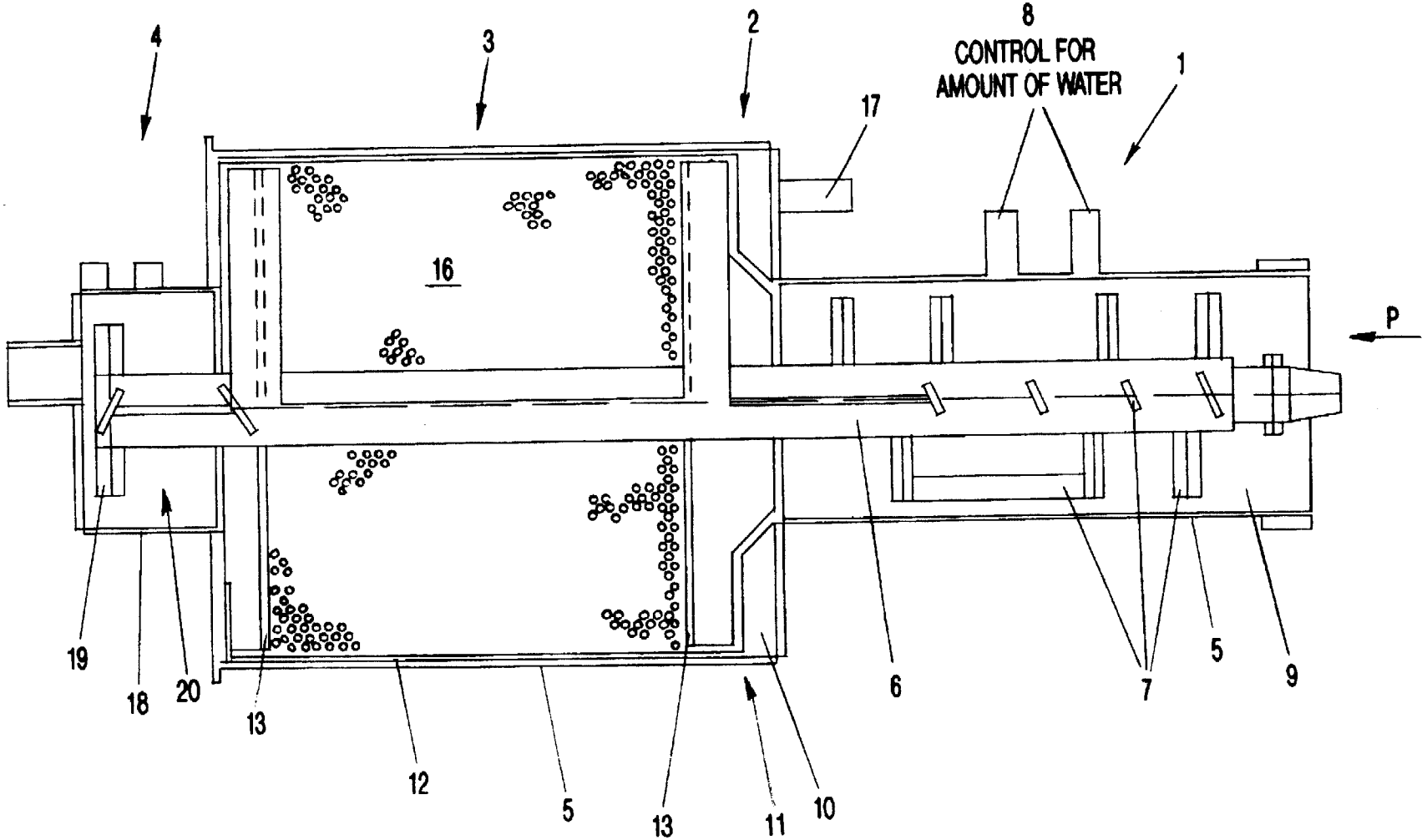
FIG. 1 shows a longitudinal section of the inventive paint manufacturing device.
Figure 2:
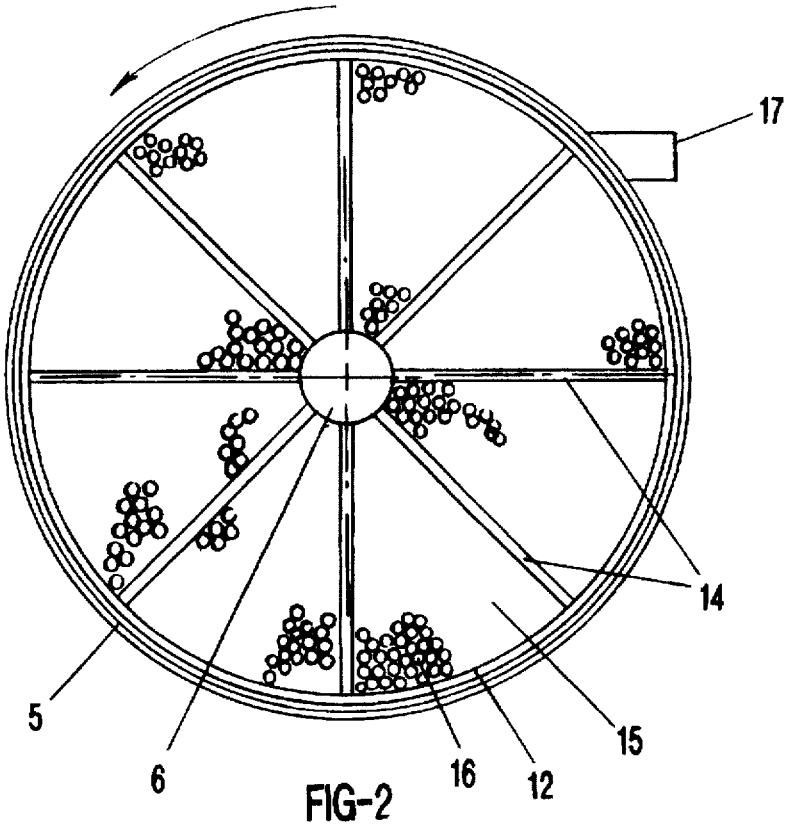
FIG. 2 shows a cross-sectional view of the device in the area of the drum.
Figure 3:
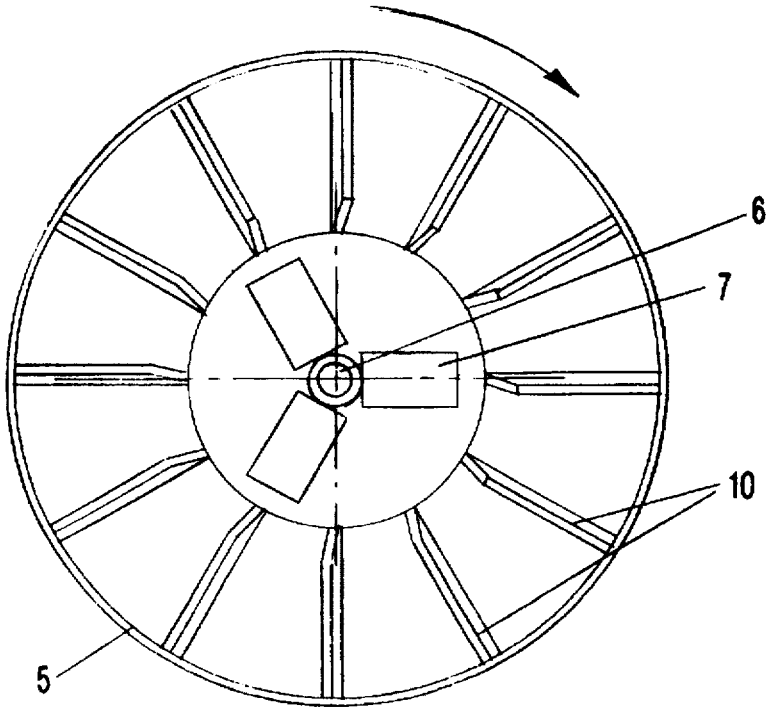
FIG. 3 shows a cross-sectional view in the area of the shearing blades.

The present invention will now be described in detail with the aid of a specific embodiment utilizing FIGS. 1 through 3.

The device for manufacturing paint by mixing dry paint powder with water is comprised, in sequence, of a paste mixing zone 1, a shearing zone 2, a grinding zone 3 and an exit zone 4. In a common mixing and conveying pipe 5 a shaft 6 is rotatably supported and is rotated by a corresponding non-represented drive. In the shearing zone 2 as well as within the grinding zone 3 the mixing and conveying tube 5 has a substantially greater diameter than within the paste mixing zone 1.

Within the paste mixing zone 1 the shaft 6 positioned within the mixing and conveying pipe 5 is provided with mixing and conveying paddles 7. Furthermore, the mixing and conveying tube 5 is provided with a water inlet 8 (schematically shown as two tubes; other arrangements are possible). The shaft 6 with its mixing and conveying paddles 7 forms a mixing and conveying device 9 for the dry paint powder supplied thereto.

In the shearing zone 2 the mixing and conveying pipe 5 is provided with slantedly arranged shearing blades 10 at the inner end face The blades 10 are uniformly distributed over the circumference of the pipe 5. These shearing blades 10 define a conveying device 11 for the paint paste produced within the paste mixing zone 1 into the grinding zone 3 arranged downstream thereof.

The grinding zone 3 is formed by a cylindrical drum 12 which is fixedly connected to the shaft 6. While the cylindrical mantle surface of the drum 12 is closed, the two end faces 13 of the drum 12 are provided with openings, for example, by using perforated plates or sieve plates. In the interior of the drum 12 radially positioned partitions 14 are arranged which divide the drum into individual segments 15. The partitions 14 are also comprised of perforated plates and/or sieve plates. These segments 15 are filled with balls 16 made of glass, metal, ceramic or any other suitable hard material. The diameter of these balls 16 is, of course, greater than the diameter of the openings in the end faces 13 and the partitions 14. The mixing and conveying pipe 5 in the area of the grinding zone 3 is also provided with a water inlet 17 (which may also be comprised of one or more tubes) which is, however, not necessary for proper operation of the device.

The exit zone 4 is formed by a flanged outlet socket 18 which is rotatably supported so that the required filling level within the mixing device can be adjusted.

Furthermore, the exit zone 4 is provided with a connecting device for a pump.

Within the outlet socket 18 the shaft 6 is provided with mixing and conveying paddles 19 which constitute an additional mixing and conveying device 20.

The paint mixer functions as follows.

The shaft 6 with its mixing and conveying paddles 7, 19 as well as with the drum 12 fixedly connected thereto is rotated so that the paint mixer is in operating condition. Into the paste mixing zone 1 the dry paint powder is introduced. This is schematically represented by the arrow P. The dry paint powder is then entrained by the mixing and conveying paddles 7 and mixed with the water which is supplied through the water inlet 8 and is simultaneously transported into the shearing zone 2. Within this paste mixing zone 1 water is supplied to the metered amount of dry paint powder in such an amount that a paint paste results which is being mixed by the mixing and conveying paddles 7.

This paste is then conveyed into the shearing zone 2 and is forwardly transported by the fixedly and slantedly arranged shearing blades 10 so that the paste is introduced through the end face 13 in the form of a perforated plate into the segments 15 of the drum 12. It is possible to add more water via the water inlet 17 so that a thinner paste will result.

Within the segments 15 of the drum 12 a mixing and grinding of the paint paste results due to the constant movement of the balls 16 so that after completed homogenization liquid paint will result. This liquid paint exits through the end face 13 of the drum 12 and enters the mixing and conveying device 20 at the exit zone 4 from where the finished liquid paint can be pumped and supplied to the user.

The present invention is, of course, in no way restricted to the specific disclosure of the specification and drawings, but also encompasses any modifications within the scope of the appended claims.

What we claim is:

1. A device for manufacturing paint by mixing dry paint powder with water, said device comprising:

a paste mixing zone for mixing a dry paint powder with water to a paint paste, said paste mixing zone having an inlet for the dry paint powder;

said paste mixing zone having a mixing and conveying member and a water inlet for supplying water to the dry paint powder;

a grinding zone, positioned adjacent to said paste mixing zone, comprising means for grinding the dry paint powder contained in the paint paste to produce finished paint from the paint paste; and an exit zone positioned adjacent to said grinding zone for removing the finished paint.

2. A device according to claim 1, comprising a mixing and conveying pipe in which said paste mixing zone, said grinding zone, and said exit zone are positioned in sequence, wherein said mixing and conveying member comprises a shaft positioned in said mixing and conveying pipe and wherein said water inlet is connected to said mixing and conveying pipe.

3. A device according to claim 2, comprising a means for controlling an amount of water as a function of an amount of the dry paint powder fed into said paste mixing zone.

4. A device according to claim 2, wherein said means for grinding includes a plurality of grinding members arranged in a dense packing in which said grinding members rest at one another and are movable relative to one another, said paint paste being passed through said packing of said grinding members.

5. A device according to claim 4, wherein said grinding members are balls.

6. A device according to claim 4, wherein said grinding zone comprises a cylindrical drum for receiving said grinding members and wherein said cylindrical drum has a first end face and a second end face.

7. A device according to claim 6, wherein said first and said second end faces are perforated plates.

8. A device according to claim 6, wherein said first and second end faces are sieve plates.

9. A device according to claim 6, wherein said cylindrical drum comprises partitions for dividing said cylindrical drum into segments.

10. A device according to claim 9, wherein said partitions are perforated plates.

11. A device according to claim 9, wherein said partitions are sieve plates.

12. A device according to claim 2, wherein said shaft extends from said paste mixing zone to said exit zone through said mixing and conveying pipe and wherein said cylindrical drum is fixedly connected to said shaft.

13. A device according to claim 1, wherein said grinding zone has an additional water inlet.

14. A device according to claim 1, wherein said exit zone comprises a rotatable outlet socket with which a required filling level within said device is adjustable.

15. A device according to claim 1, further comprising an auxiliary conveying zone, positioned between said paste mixing zone and said grinding zone, for conveying the paint paste.

16. A device according to claim 15, wherein said auxiliary conveying zone is comprised of stationary slanted blades.

17. A device according to claim 1, further comprising an auxiliary mixing and conveying zone positioned between said grinding zone and said exit zone.

* * * * *